US011938364B1

(12) United States Patent
Rohlf

(10) Patent No.: US 11,938,364 B1
(45) Date of Patent: Mar. 26, 2024

(54) TWO-IN-ONE WEIGHTED HAND GRIP WALKING POLES AND CURL BAR AND METHOD OF USING THE SAME

(71) Applicant: Teri Anne Rohlf, Bryan, TX (US)

(72) Inventor: Teri Anne Rohlf, Bryan, TX (US)

( * ) Notice: Subject to any disclaimer, the term of this patent is extended or adjusted under 35 U.S.C. 154(b) by 537 days.

(21) Appl. No.: 17/082,311

(22) Filed: Oct. 28, 2020

Related U.S. Application Data

(60) Provisional application No. 62/933,371, filed on Nov. 9, 2019.

(51) Int. Cl.

| | |
|---|---|
| ***A63B 15/00*** | (2006.01) |
| ***A45B 3/00*** | (2006.01) |
| ***A45B 9/02*** | (2006.01) |
| ***A45B 9/04*** | (2006.01) |
| ***A63B 21/072*** | (2006.01) |

(52) U.S. Cl.
CPC ..... *A63B 15/00* (2013.01); *A45B 3/00* (2013.01); *A45B 9/02* (2013.01); *A45B 9/04* (2013.01); *A63B 21/072* (2013.01); *A45B 2200/055* (2013.01)

(58) Field of Classification Search
CPC ..... A63B 15/00; A63B 21/072; A63B 21/00; A63B 2209/00; A45B 3/00; A45B 9/02; A45B 9/04; A45B 2200/055; B29C 70/06; B29B 17/00; Y02W 30/06
See application file for complete search history.

(56) References Cited

U.S. PATENT DOCUMENTS

| | | | | | |
|---|---|---|---|---|---|
| 1,138,417 | A * | 5/1915 | Rottenburg | A45B 3/00 | 248/187.1 |
| 1,697,552 | A * | 1/1929 | Boultbee | A45B 5/00 | 135/66 |
| 2,192,475 | A * | 3/1940 | Lauckner | A45B 5/00 | 248/155 |
| 3,374,022 | A * | 3/1968 | Tagg | A45B 3/00 | 294/23 |
| 3,834,697 | A * | 9/1974 | McNamara, Jr. | A63B 69/0026 | 482/109 |
| 4,239,212 | A * | 12/1980 | Hickey | A63B 21/00043 | 482/126 |

(Continued)

*Primary Examiner* — Garrett K Atkinson
(74) *Attorney, Agent, or Firm* — Taboada Law Firm, PLLC; John M. Taboada

(57) ABSTRACT

A method and apparatus for exercising are disclosed, including providing two apparatuses, each apparatus comprising: a hand grip body comprising a thumb recess and three or more finger recesses formed into the hand grip body; a weighted baton at least partially disposed within the hand grip body; a dual-purpose connector having a proximal end and a distal end, the dual-purpose connector comprising a coupling portion, wherein the proximal end of the dual-purpose connector is coupled to the weighted baton; and a walking pole coupled to the distal end of the dual-purpose connector; inverting an apparatus relative to the other; coupling the apparatuses together by the coupling portion; and grasping and using the coupled apparatuses to perform strengthening exercises, wherein the strengthening exercises is at least one of: an arm curl, a squat, a deadlift, an upward row, a shoulder flexion, and an overhead press. Other embodiments are described and claimed.

7 Claims, 6 Drawing Sheets

(56) References Cited

U.S. PATENT DOCUMENTS 4,786,082 A * 11/1988 Swietlik ..... A45B 5/00 135/66
4,982,960 A * 1/1991 David ..... F41B 15/02 D22/117
5,108,097 A * 4/1992 Ashihara ..... F41B 15/025 463/47.6
5,108,098 A * 4/1992 Ashihara ..... F21V 33/0064 463/47.4
5,174,567 A * 12/1992 Nordstrom ..... A63B 69/0024 473/256
5,188,362 A * 2/1993 Ashihara ..... F41B 15/025 463/47.6
5,363,285 A * 11/1994 Wideman ..... F21L 2/00 463/47.4
5,407,197 A * 4/1995 Parsons ..... F41B 15/022 463/47.7
5,609,336 A * 3/1997 Tashjian ..... A63B 60/28 473/560
5,647,591 A * 7/1997 Parsons ..... F41B 15/02 463/47.4
5,778,914 A * 7/1998 Trani ..... A45B 9/00 135/66
5,788,608 A * 8/1998 Wilkinson ..... A63C 11/221 482/74
D404,785 S * 1/1999 Lenhart ..... D21/775
5,930,932 A * 8/1999 Peterson ..... F41A 23/16 42/94
6,077,178 A * 6/2000 Brandt ..... A63B 60/04 473/566
6,505,429 B2 * 1/2003 Percival ..... F41A 23/12 248/164
D533,761 S * 12/2006 Lin ..... D8/107
D536,233 S * 2/2007 Lin ..... D8/107
7,316,449 B2 * 1/2008 Lynch ..... A61H 3/02 248/155.2
D621,602 S * 8/2010 White ..... D3/12
D654,774 S * 2/2012 Mullen ..... D8/107
8,500,609 B1 * 8/2013 Williams ..... A45B 3/00 135/65
D742,465 S * 11/2015 Bain ..... D21/767
9,511,268 B1 * 12/2016 Levy ..... A63B 60/24
9,622,554 B2 * 4/2017 Green ..... A63C 11/00
9,737,788 B1 * 8/2017 Pierce ..... A63C 11/228
9,746,268 B2 * 8/2017 Antell ..... F41A 23/10
10,352,645 B1 * 7/2019 Antell ..... F41A 23/10
D910,417 S * 2/2021 Wang ..... D8/322
11,166,530 B1 * 11/2021 Wilson, Jr. ..... A45B 5/00
2003/0139215 A1 * 7/2003 Todd ..... F41B 15/025 463/47.6
2004/0163693 A1 * 8/2004 Uemura ..... A63C 11/2228 135/72
2005/0077332 A1 * 4/2005 Parsons ..... A45F 5/02 224/197
2005/0235902 A1 * 10/2005 Evans ..... G09F 17/00 116/174
2007/0184943 A1 * 8/2007 Davies ..... A63B 21/0724 482/93
2008/0096738 A1 * 4/2008 Kim ..... A63B 21/0726 482/108
2008/0127721 A1 * 6/2008 Shields ..... G01M 1/365 473/316
2009/0054209 A1 * 2/2009 Takeishi ..... G01C 22/006 235/105
2009/0250917 A1 * 10/2009 Lenhart ..... A45B 9/02 280/821
2010/0178981 A1 * 7/2010 Holcomb ..... A63F 13/98 463/37
2012/0046136 A1 * 2/2012 Allen ..... A63B 60/10 264/266
2012/0145206 A1 * 6/2012 Parry ..... A45B 9/02 135/66
2012/0214622 A1 * 8/2012 Rockhill ..... A63B 15/00 473/422
2013/0095984 A1 * 4/2013 Agate ..... A63B 21/0618 482/106
2015/0072809 A1 * 3/2015 Palumbo ..... A63B 59/70 473/560
2016/0018180 A1 * 1/2016 Antell ..... F41A 23/18 42/94
2016/0135554 A1 * 5/2016 Green ..... A45B 5/00 135/66
2018/0177267 A1 * 6/2018 D'Jay ..... A45B 9/02
2018/0177268 A1 * 6/2018 D'Jay ..... A45B 9/02
2018/0221738 A1 * 8/2018 Panozzo ..... A63B 59/70
2018/0263343 A1 * 9/2018 Kier ..... A45B 9/00
2021/0228972 A1 * 7/2021 Heim ..... A63C 11/227

* cited by examiner

TWO-IN-ONE WEIGHTED HAND GRIP WALKING POLES AND CURL BAR AND METHOD OF USING THE SAME

I. CROSS REFERENCE TO RELATED APPLICATIONS

This application claims the benefit of the filing date of U.S. Provisional Patent Application Ser. No. 62/933,371, filed on Nov. 9, 2019, entitled "2 in 1 CONVERTIBLE VARIABLE WEIGHTED HAND GRIP AND WALKING POLES," the entire disclosure of which is hereby incorporated by reference into the present disclosure.

II. BACKGROUND

The present invention pertains to walking poles. More particularly, the invention relates to a two-in-one weighted hand grip walking poles and curl bar and a method of using the same.

III. SUMMARY

In one respect, disclosed is an apparatus for exercising comprising a hand grip body having a proximal end and a distal end, the hand grip body comprising a thumb recess formed into the hand grip body at the proximal end of the hand grip body and three or more finger recesses formed into the hand grip body between the proximal end and the distal end of the hand grip body; a weighted baton having a proximal end and a distal end, wherein the proximal end of the weighted baton is at least partially disposed within the distal end of the hand grip body; and a dual-purpose connector having a proximal end and a distal end, the dual-purpose connector comprising a coupling portion, wherein the proximal end of the dual-purpose connector is coupled to the distal end of the weighted baton.

In another respect, disclosed is a method for exercising, the method comprising: providing two apparatuses for exercising, wherein each of the apparatuses for exercising comprises: a hand grip body having a proximal end and a distal end, the hand grip body comprising a thumb recess formed into the hand grip body at the proximal end of the hand grip body and three or more finger recesses formed into the hand grip body between the proximal end and the distal end of the hand grip body; a weighted baton having a proximal end and a distal end, wherein the proximal end of the weighted baton is at least partially disposed within the distal end of the hand grip body; a dual-purpose connector having a proximal end and a distal end, the dual-purpose connector comprising a coupling portion, wherein the proximal end of the dual-purpose connector is coupled to the distal end of the weighted baton; and a walking pole have a proximal end and a distal end, wherein the proximal end of the walking pole is coupled to the distal end of the dual-purpose connector; inverting one of the apparatuses relative to the other apparatus; coupling the apparatuses together by coupling the coupling portion of each apparatus to the walking pole of the other apparatus; and grasping and using the coupled apparatuses to perform strengthening exercises, wherein the strengthening exercises is at least one of: an arm curl, a squat, a deadlift, an upward row, a shoulder flexion, and an overhead press.

Numerous additional embodiments are also possible.

IV. BRIEF DESCRIPTION OF THE DRAWINGS

Other objects and advantages of the invention may become apparent upon reading the detailed description and upon reference to the accompanying drawings.

Figure 1:
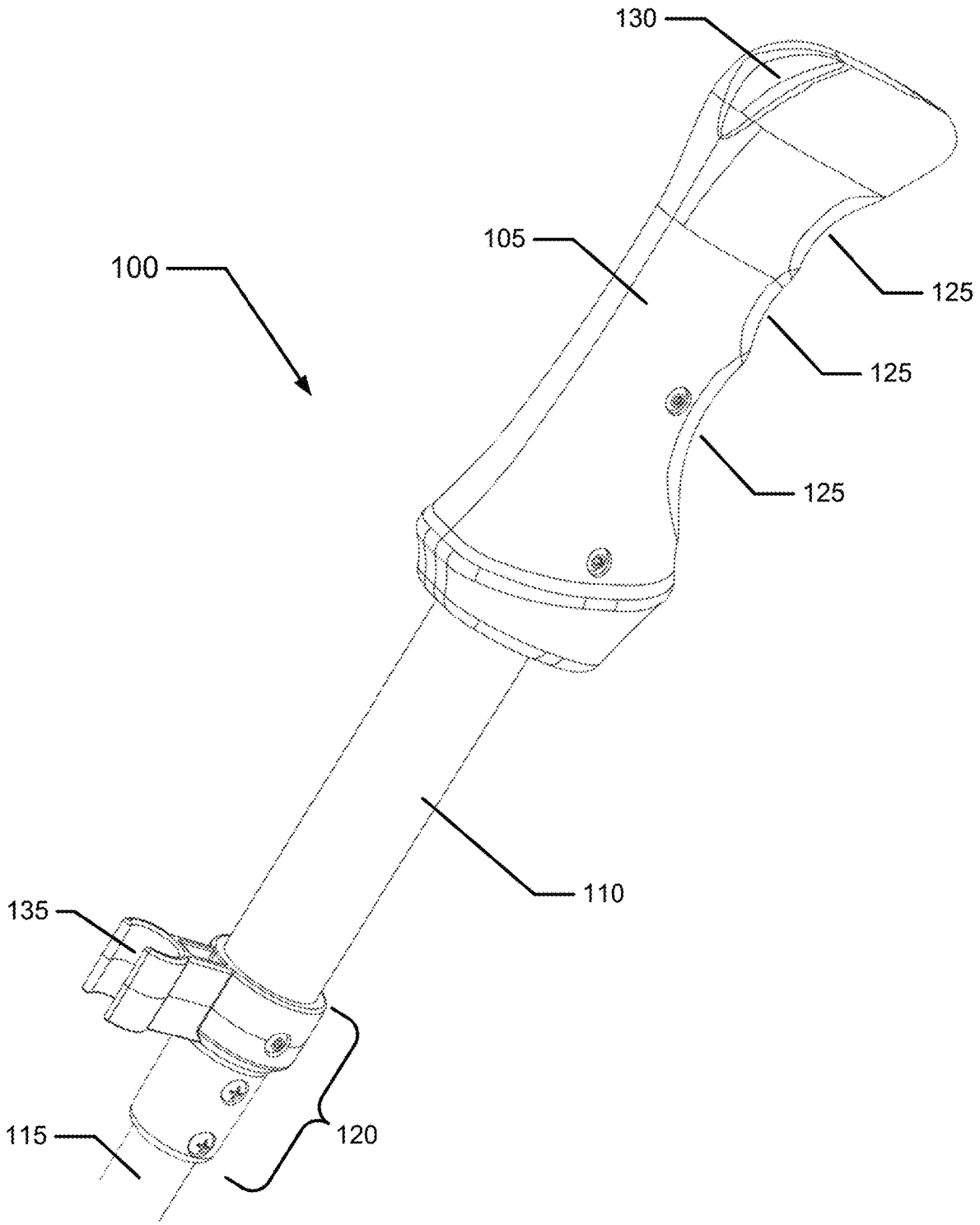
FIG. 1 is a side perspective view of a portion of a two-in-one weighted hand grip walking pole and curl bar, in accordance with some embodiments.

While the invention is subject to various modifications and alternative forms, specific embodiments thereof are shown by way of example in the drawings and the accompanying detailed description. It should be understood, however, that the drawings and detailed description are not intended to limit the invention to the particular embodiments. This disclosure is instead intended to cover all modifications, equivalents, and alternatives falling within the scope of the present invention as defined by the appended claims.

V. DETAILED DESCRIPTION

One or more embodiments of the invention are described below. It should be noted that these and any other embodiments are exemplary and are intended to be illustrative of the invention rather than limiting. While the invention is widely applicable to different types of systems, it is impossible to include all of the possible embodiments and contexts of the invention in this disclosure. Upon reading this disclosure, many alternative embodiments of the present invention will be apparent to persons of ordinary skill in the art.

Walking is regarded as an easy and cost-effective form of exercise. Many fitness walkers use walking poles to provide balance and stability during a progressive walking program. Additional benefits of using walking poles include improving posture and increasing calories burned. Walking poles are predominately manufactured to be of minimal weight due to their use in hiking. Therefore, in order to increase the benefits of a resistive training program during a walk, fitness walkers carry hand weights, wear weighted vests, or strap weights around their ankles. Unfortunately, doing so does not lend itself to the use of walking poles and this form of weighted walking adds undue stress on tendons, ligaments, and joints which can lead to potential injuries.

A need exists for a multi-purpose apparatus for resistive training of upper body, lower body, trunk, and core for during, before, or after a walk. The embodiment or embodiments described herein solve these problems and others by proposing two-in-one weighted hand grip walking poles and curl bar and method for using the same. The two-in-one weighted hand grip walking poles and curl bar, embodies the positive attributes of both walking poles and free weights in one exercise apparatus. The user, while walking or hiking with the two-in-one weighted hand grip walking poles and curl bar will burn more calories, gently strengthen a variety of muscle groups, and maintain stability and balance throughout a progressive walking program. The two-in-one weighted hand grip walking poles and curl bar have hand grips designed with both thumb and shallow finger recesses to provide support and comfort. The hand grip will allow for two positions of grasp. The hand grip is hollow and encases a weighted tubular baton which, in some embodiments, is permanently affixed to the upper most part of the adjustable, telescoping pole by a dual-purpose connector. The dual-purpose connector not only secures the hand grip with the tubular weighted baton unit to a pole, but when the poles are inverted with respect to each other, the dual-purpose connecter is used to removably connect two two-in-one weighted hand grip walking poles to create a secondary exercise equipment, a curl or straight bar which allows the user to perform additional strengthening exercises for the upper and lower body before, during, or after walking.

FIG. 1 is a side perspective view of a portion of a two-in-one weighted hand grip walking pole and curl bar, in accordance with some embodiments.

Figure 2:
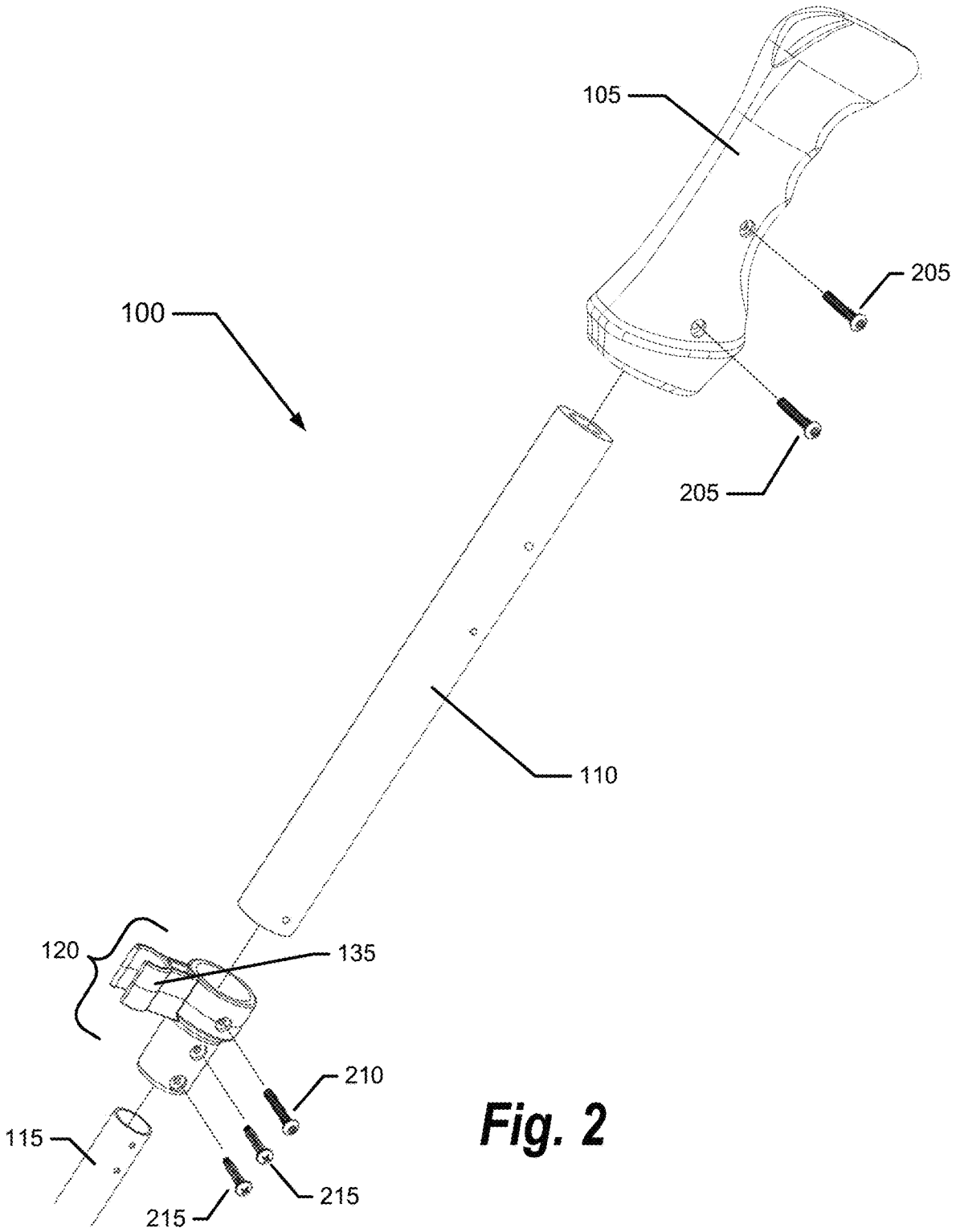
FIG. 2 is an exploded side perspective view of a portion of the two-in-one weighted hand grip walking poles and curl bar, in accordance with some embodiments.

FIG. 2 is an exploded side perspective view of a portion of the two-in-one weighted hand grip walking poles and curl bar, in accordance with some embodiments.

Figure 3:
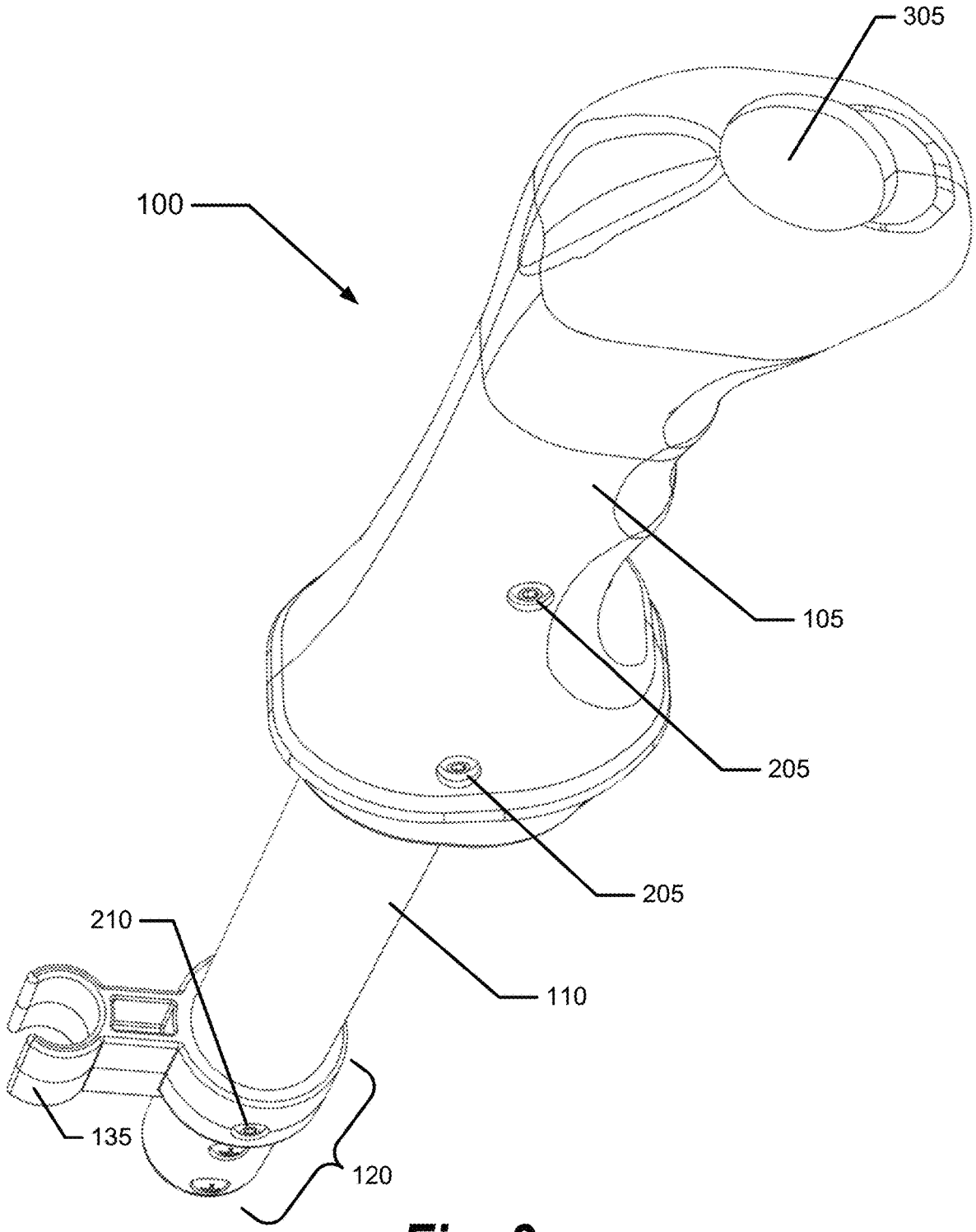
FIG. 3 is a perspective view of the top of a portion of the two-in-one weighted hand grip walking poles and curl bar, in accordance with some embodiments.

FIG. 3 is a perspective view of the top of a portion of the two-in-one weighted hand grip walking poles and curl bar, in accordance with some embodiments.

Figures 4, 5:
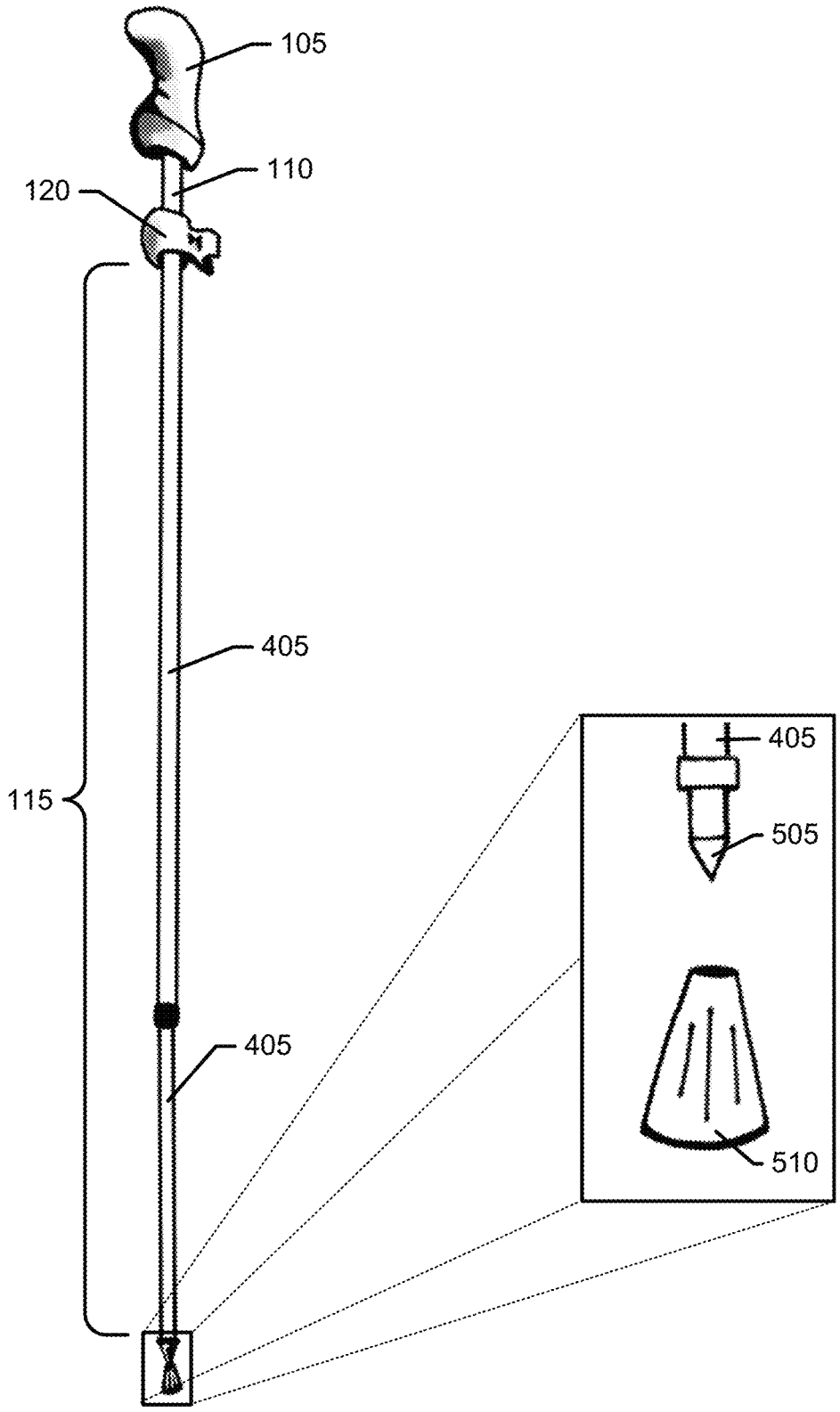
FIG. 4 is a side perspective view of a two-in-one weighted hand grip walking pole and curl bar, in accordance with some embodiments.
FIG. 5 is an enlarged illustration showing a rubber tip separated from the tip of a walking pole, in accordance with some embodiments.

FIG. 4 is a side perspective view of a two-in-one weighted hand grip walking pole and curl bar, in accordance with some embodiments.

FIG. 5 is an enlarged illustration showing a rubber tip separated from the tip of a walking pole, in accordance with some embodiments.

Figure 6:
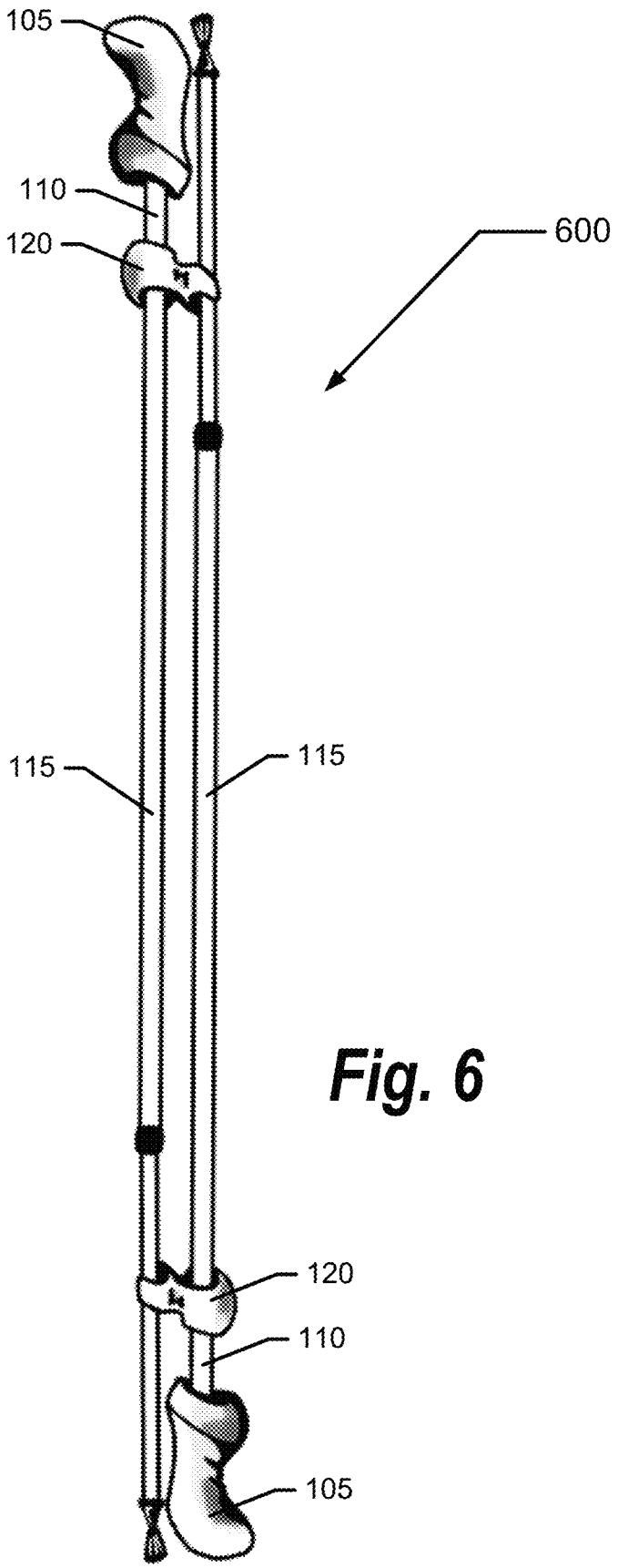
FIG. 6 is a side perspective view of two two-in-one weighted hand grip walking poles configured as a curl bar, in accordance with some embodiments.

FIG. 6 is a side perspective view of two two-in-one weighted hand grip walking poles configured as a curl bar, in accordance with some embodiments.

In some embodiments, the two-in-one weighted hand grip walking pole 100 for progressive walking programs comprises a hand grip body 105, a weighted baton 110 coupled to the hand grip body, a walking pole 115, and a dual-purpose connector 120 configured to couple the walking pole to the weighted baton. The hand grip body comprises three or more recesses 125 on the side of the hand grip body for the user's fingers and a thumb indentation 130 towards the top portion of the hand grip body. The recesses and indentation provide a comfortable grip position for the user of the walking pole. In some embodiments, additional thumb indentations may be positioned on the side of the hand grip body in order to provide an additional grip position for the user. The dual-purpose connector comprises a coupling portion 135 configured to couple two inverted walking poles together, as illustrated in FIG. 6, in order to create a curl or straight bar 600 which a user may then use to perform additional strengthening exercises for the upper and lower body before, during, or after walking. The weighted baton provides the bulk of the weight of the walking pole and may be configured so that the total weight of the walking pole results in such as but not limited to approximately either 0.75 lbs., 1.5 lbs., or 2.5 lbs. In some embodiments, the weighted baton is a solid unibody member whose weight may be adjusted by selection of the particular material used in its construction and/or having one or more voids in the unibody member. In some embodiments, the weighted baton comprises an inner space portion which may be filled with a weighted material such as but not limited to iron or lead which may be varied in order to achieve different total walking pole weights. In some embodiments the weighted baton is permanently coupled to the hand grip body. In an alternate embodiment, the weighted baton may be removably coupled with one or more screws 205. In such an embodiment, the weighted baton may be swapped in order to vary the weight of the walking pole depending on the user's preference. In some embodiments the weighted baton is permanently coupled to the dual-purpose connector. In an alternate embodiment, the weighted baton is removably coupled to the dual-purpose connector with one or more screws 210. In some embodiments the walking pole is permanently coupled to the dual-purpose connector. In an alternate embodiment, the walking pole is removably coupled to the dual-purpose connector with one or more screws 215. In some embodiments, the walking pole comprises a metal carbide tip 505 which may be covered by a rubber tip 510. The rubber tip is used for walking on paved surfaces and the metal carbide tip is used for walking in unpaved surfaces. In some embodiments, the walking pole comprises two or three telescoping or removably coupled segments 405 configured to adjust the overall length of the walking pole to a user's height, between approximately forty-eight inches and seventy-six inches.

In some embodiments, the hand grip body may further comprise a hollow cavity 305 where a spare rubber tip 510 for the walking pole may be stored. Thus if the rubber tip of the walking pole becomes worn during a walk and exposes the metal carbide tip 505 of the walking pole, the user may remove the spare rubber tip from the hollow cavity and place the spare rubber tip 510 onto the carbide tip, as illustrated in FIG. 4 and FIG. 5. The hollow cavity may be covered with a removable plug.

In some embodiments, the hand grip body, the weighted baton, and dual-purpose connector may form an integrated assembly. In such an embodiment, the integrated assembly may be coupled to conventional minimum weight walking and hiking poles in order to convert them to a weighted hand grip walking pole and curl bar. Although separate components (the hand grip body, the weighted baton, and the dual-purpose connector) are described, those skilled in the art will realize that integrated assemblies of some or all of these components may also be used. In such an apparatus, the integrated assembly is unibody. Accordingly, the concepts, apparatus, and techniques described herein are not limited to any particular combination of these components.

In some embodiments, the hand grip body, the weighted baton, and dual-purpose connector may be coupled to just the upper most segment of a walking pole. In such an embodiment, the integrated assembly may be coupled to conventional minimum weight walking and hiking poles in order to convert them to a weighted hand grip walking pole and curl bar.

In some embodiments, the hand grip body is formed of a monolithic piece of material, such as (but not limited to) dense foam, plastic, and the like, all of which are well known in the art for their suitability for grip material.

In some embodiments, the baton is formed of a monolithic piece of material, such as (but not limited to) stainless steel, aluminum, carbide fiber, plastic and the like, all of which are well known in the art for their suitability for structural integrity. In some embodiments with the baton having an inner space portion, the weighted material within the baton comprises iron or lead.

Figure 7:
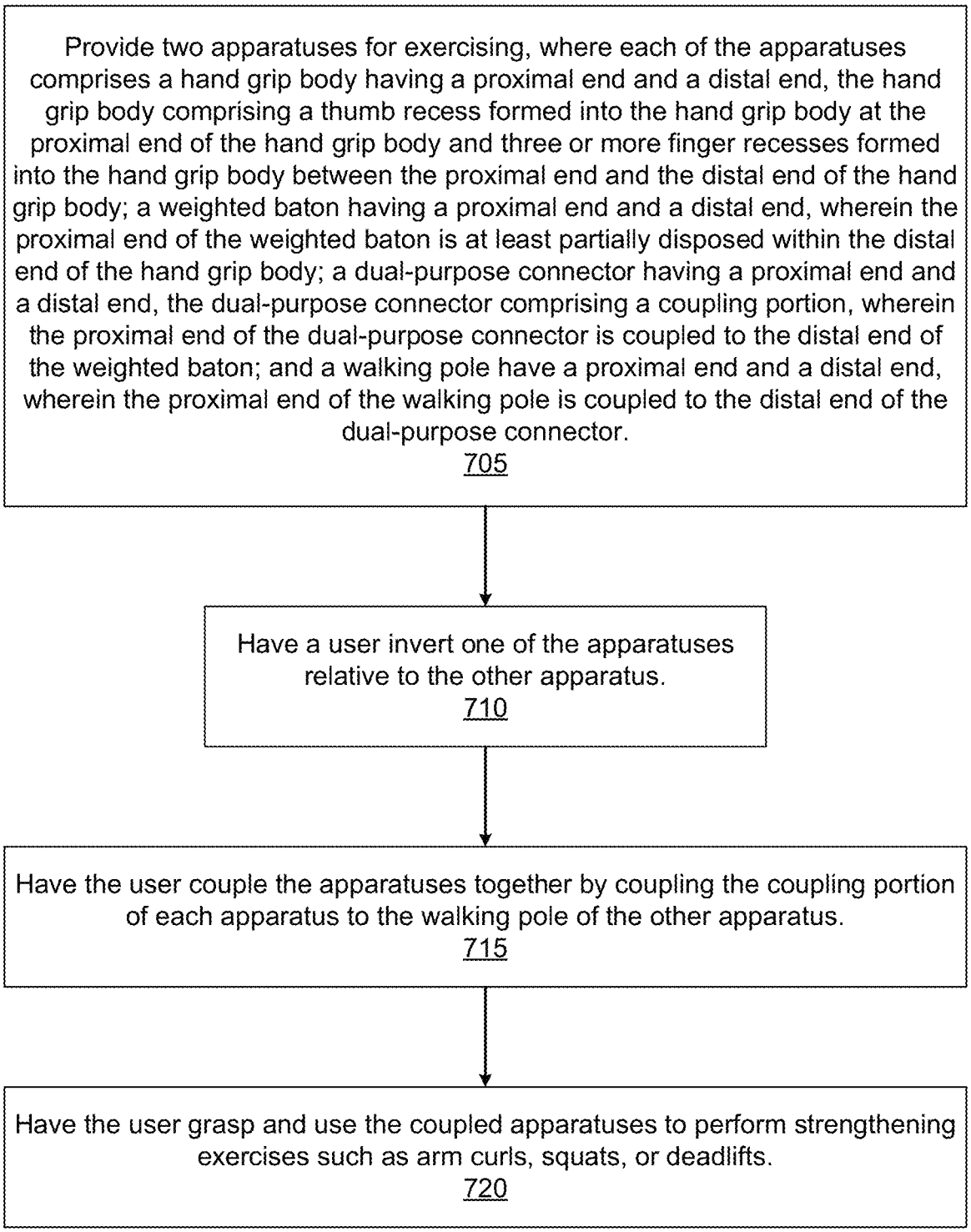
FIG. 7 is a flowchart illustrating a method for using two two-in-one weighted hand grip walking poles and curl bar illustrated in FIG. 1, FIG. 2, FIG. 3, FIG. 4, FIG. 5, and FIG. 6, in accordance with some embodiments.

FIG. 7 is a flowchart illustrating a method for using two two-in-one weighted hand grip walking poles and curl bar illustrated in FIG. 1, FIG. 2, FIG. 3, FIG. 4, FIG. 5, and FIG. 6, in accordance with some embodiments.

According to one embodiment of the present invention illustrated in FIGS. 7, the method for exercising begins at block 705, where two apparatuses for exercising are provided, wherein each of the apparatuses for exercising comprises a hand grip body having a proximal end and a distal end, the hand grip body comprising a thumb recess formed into the hand grip body at the proximal end of the hand grip body and three or more finger recesses formed into the hand grip body between the proximal end and the distal end of the hand grip body; a weighted baton having a proximal end and a distal end, wherein the proximal end of the weighted baton is at least partially disposed within the distal end of the hand grip body; a dual-purpose connector having a proximal end and a distal end, the dual-purpose connector comprising a coupling portion, wherein the proximal end of the dual-purpose connector is coupled to the distal end of the weighted baton; and a walking pole have a proximal end and a distal end, wherein the proximal end of the walking pole is coupled to the distal end of the dual-purpose connector. Next, at block 710, a user inverts one of the apparatuses relative to the other apparatus. At block 715, the user couples the apparatuses together by coupling the coupling portion of each apparatus to the walking pole of the other apparatus. Lastly, at block 720, the user grasps and uses the coupled apparatuses to perform strengthening exercises such as arm curls, squats, deadlifts, upward rows, shoulder flexions, and overhead presses.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

The benefits and advantages that may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions, and improvements to the embodiments described above are possible. It is contemplated that these variations, modifications, additions, and improvements fall within the scope of the invention as detailed within the following claims.

The invention claimed is:

1. An apparatus comprising:

a hand grip body having a proximal end and a distal end, the hand grip body comprising a thumb indentation formed into the hand grip body at the proximal end of the hand grip body and three or more finger recesses formed into the hand grip body between the proximal end and the distal end of the hand grip body;

a weighted baton having a proximal end and a distal end, wherein the proximal end of the weighted baton is at least partially disposed within the distal end of the hand grip body;

a dual-purpose connector having a long axis between a proximal end and a distal end, the dual-purpose connector comprising a coupling portion extending perpendicular from the long axis and positioned between the proximal end and the distal end of the dual-purpose connector, wherein the proximal end of the dual-purpose connector is coupled to the distal end of the weighted baton; and a walking pole having a proximal end and a distal end, wherein the proximal end of the walking pole is coupled to the distal end of the dual-purpose connector, the coupling portion of the dual-purpose connector removably coupled to a distal end of a second walking pole of a second apparatus and a second coupling portion of a second dual-purpose connecter of the second apparatus removably coupled to the distal end of the walking pole of the apparatus, such that the apparatuses are inverted relative to one another; wherein when the apparatuses are coupled, a user can grasp the coupled apparatuses to perform strengthening exercises and when the apparatuses are separated, the user can use the separated apparatuses to assist in walking.

2. The apparatus of claim 1, further comprising a hollow cavity at the proximal end of the hand grip body, wherein the hollow cavity is configured to accommodate a spare walking pole tip.

3. The apparatus of claim 2, further comprising a plug removably coupled into the hollow cavity at the proximal end of the hand grip body.

4. The apparatus of claim 1, further comprising one or more second thumb indentations formed into side of the hand grip body between the proximal end and the distal end of the hand grip body.

5. The apparatus of claim 1, wherein the apparatus is unibody.

6. The apparatus of claim 1, wherein the weighted baton is a solid unibody member.

7. The apparatus of claim 1, wherein the weighted baton comprises an inner space portion, the inner space portion configured to be filled with a weighted material.

* * * * *